US012140025B1

(12) United States Patent
Zeng et al.

(10) Patent No.: US 12,140,025 B1
(45) Date of Patent: Nov. 12, 2024

(54) DIRECTIONAL DRILLING METHOD FOR BRANCHING BOREHOLE WITH SHORT RADIUS AND SYSTEM

(71) Applicant: CHINA UNIVERSITY OF MINING AND TECHNOLOGY, BEIJING, Beijing (CN)

(72) Inventors: Yifan Zeng, Beijing (CN); Weihong Yang, Beijing (CN); Qiang Wu, Beijing (CN); Xuan Xiao, Beijing (CN); Kai Pang, Beijing (CN); Xinjiang Wei, Beijing (CN); Xue Liu, Beijing (CN); Aoshuang Mei, Beijing (CN); Shihao Meng, Beijing (CN); Chao Yu, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/735,748

(22) Filed: Jun. 6, 2024

(30) Foreign Application Priority Data

Dec. 29, 2023 (CN) ..... 202311862880.9

(51) Int. Cl.
*E21B 7/06* (2006.01)
*E21B 47/022* (2012.01)

(52) U.S. Cl.
CPC ..... *E21B 7/061* (2013.01); *E21B 47/022* (2013.01)

(58) Field of Classification Search
CPC ..... E21B 7/04
See application file for complete search history.

(56) References Cited

U.S. PATENT DOCUMENTS

2021/0285290 A1* 9/2021 D'Silva ..... E21B 7/062

FOREIGN PATENT DOCUMENTS

| | | | |
|---|---|---|---|
| CN | 114016910 | A | 2/2022 |
| CN | 116006076 | A | 4/2023 |
| CN | 117108201 | A | 11/2023 |
| WO | 2005108734 | A1 | 11/2005 |

OTHER PUBLICATIONS

First Office Action issued in counterpart Chinese Patent Application No. 202311862880.9, dated May 21, 2024.

* cited by examiner

*Primary Examiner* — Tara Schimpf
*Assistant Examiner* — Lamia Quaim
(74) *Attorney, Agent, or Firm* — Westbridge IP LLC

(57) ABSTRACT

A directional drilling method applied to a rigid bending joint directional drilling device includes: obtaining geological data; determining a lateral drilling point and a target point of a branching borehole based on the geological data; drawing a target borehole trajectory of the branching borehole based on the lateral drilling point and the target point; obtaining parameters of the drill pipe; determining a propulsion force corresponding to the target borehole trajectory based on the parameters, the target borehole trajectory, and the geological data; and applying the propulsion force to the rigid bending joint directional drilling device for drilling the branching borehole. A directional drilling system and related devices are also disclosed.

9 Claims, 3 Drawing Sheets

DIRECTIONAL DRILLING METHOD FOR BRANCHING BOREHOLE WITH SHORT RADIUS AND SYSTEM

CROSS-REFERENCE TO RELATED APPLICATIONS

This application claims priority to Chinese Patent Application No. 202311862880.9, filed on Dec. 29, 2023, the content of which is incorporated herein by reference in its entirety.

TECHNICAL FIELD

The disclosure relates to drilling technologies, in particular to a directional drilling method and a directional drilling system for a branching borehole with a short radius and a short vertical distance.

BACKGROUND

High-intensity and large-scale of coal mining may result in rapid developments of water conducting fracture zones. In some cases, the water conducting fracture zones may develop into a bedrock aquifer. In some coal mines, due to an absence of a red soil aquitard, an "overflow" hydraulic connection may be formed between the Quaternary Salawusu Formation aquifer (i.e., the Quaternary aquifer) and the bedrock aquifer. As a result, water in the Quaternary aquifer and the bedrock aquifer may flow into the goaf through the water conducting fracture zones. Moreover, a stress of an overlying rock may change along with an advancement of the coal seam working face. In this case, rock strata may move and be damaged. Moreover, water conducting cracks may be developed as the rock strata moves. Therefore, roof water inrush accidents in the goaf of the mine may occur easily and safety of worker may be threatened.

SUMMARY

The present disclosure provides a directional drilling method and a directional drilling system for a branching borehole with a short radius and a short vertical distance.

The directional drilling method may be applied to a rigid bending joint directional drilling device. The rigid bending joint directional drilling device may include: a wedge deflection tool and a rigid bending joint guiding unit. The rigid bending joint guide unit may include a drill pipe. The wedge deflection tool may be used to receive a contact reaction force perpendicular to a drilling wall from an axial direction of the rigid bending joint directional drilling device and to bend the rigid bending joint guiding unit.

The directional drilling method may include the following steps: obtaining geological data; determining a lateral drilling point and a target point of a branching borehole based on the geological data; drawing a target borehole trajectory of the branching borehole based on the lateral drilling point and the target point; where, a minimum value of the curvature radius of the target borehole trajectory is not less than a preset threshold, and a hole deviation angle at the target point of the target borehole trajectory satisfies a preset condition; obtain parameters of the drill pipe; determining a propulsion force corresponding to the target borehole trajectory based on the parameters, the target borehole trajectory, and the geological data; and applying the propulsion force to the rigid bending joint directional drilling device for drilling the branching borehole; where, the propulsion force is converted into the contact reaction force.

Based on a same concept, the directional drilling system for a branching borehole with a short vertical distance and a short radius according to the present disclosure may include: a rigid bending joint directional drilling device and a processor.

The rigid bending joint directional drilling device may include: a wedge deflection tool and a rigid bending joint guiding unit. The rigid bending joint guide unit may include a drill pipe. The wedge deflection tool may be used to receive a contact reaction force perpendicular to a drilling wall from an axial direction of the rigid bending joint directional drilling device and to bend the rigid bending joint guiding unit.

The processor is configured to obtain geological data; determine a lateral drilling point and a target point of a branching borehole based on the geological data; draw a target borehole trajectory of the branching borehole based on the lateral drilling point and the target point; where, a minimum value of the curvature radius of the target borehole trajectory is not less than a preset threshold, and a hole deviation angle at the target point of the target borehole trajectory satisfies a preset condition; obtain parameters of the drill pipe; determine a propulsion force corresponding to the target borehole trajectory based on the parameters, the target borehole trajectory, and the geological data; and applying the propulsion force to the rigid bending joint directional drilling device for drilling the branching borehole; where, the propulsion force is converted into the contact reaction force.

From the above descriptions, it can be seen that the directional drilling method and the directional drilling system provided by examples of the present disclosure may obtain geological data, determine a lateral drilling point and a target point of a branching borehole; draw a target borehole trajectory of the branching borehole based on the lateral drilling point and the target point; obtain parameters of the drill pipe; determine a propulsion force corresponding to the target borehole trajectory based on the parameters, the target borehole trajectory, and the geological data; and applying the propulsion force to the rigid bending joint directional drilling device for drilling the branching borehole. The propulsion force may cause the wedge deflection tool of the rigid bending joint directional drilling device to receive a contact reaction force perpendicular to an axis of the rigid bending joint directional drilling device from a drilling wall, so as to bend the rigid bending joint guiding unit. In this way, a branching borehole with a short vertical distance and a short curvature radius can be obtained. It can be seen that, the difficulty in drilling an inclined section with a short vertical distance and a short radius can be overcome.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

As disclosed in the background, as the stress of the overlying rock changes along with the advancement of the coal seam working face, the rock strata may move and be damaged. Moreover, water conducting cracks may be developed as the rock strata moves. Therefore, roof water inrush accidents in the goaf of the mine may occur easily and safety of worker may be threatened.

Figure 1:
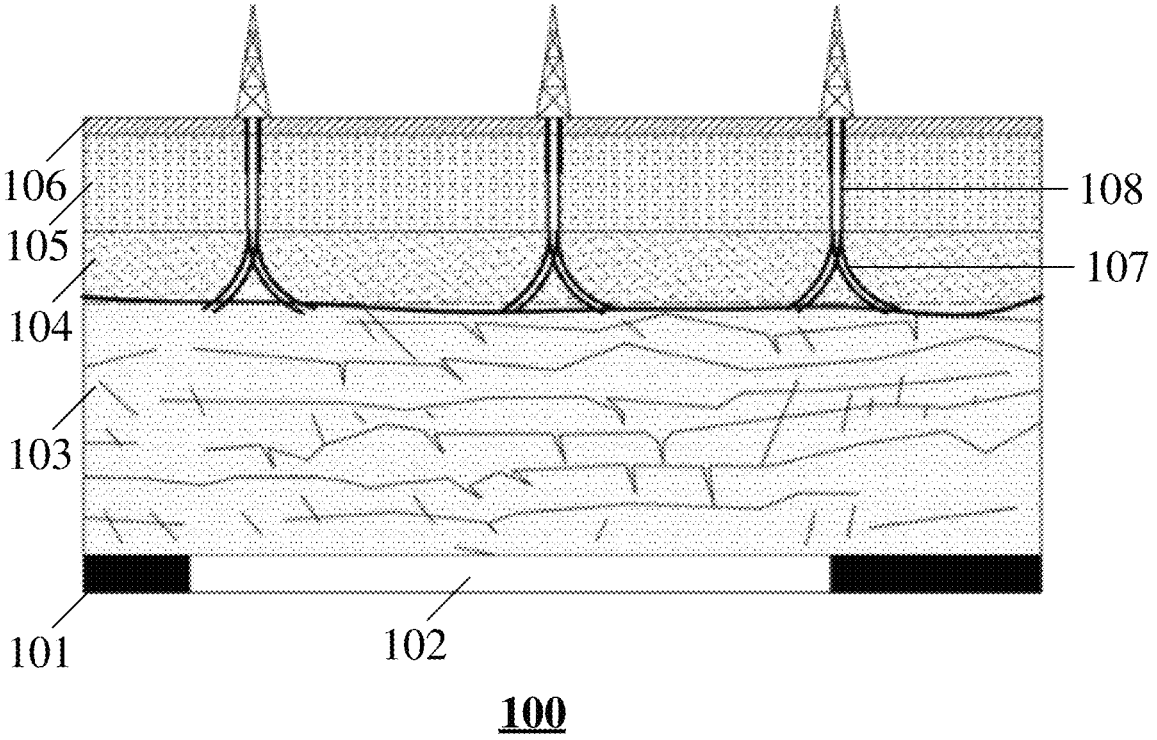
FIG. 1 is a diagram illustrating an application scenario of a directional drilling of a branching borehole with a short vertical distance and a short radius according to an example of the present disclosure.

As shown in FIG. 1, a mining area may consist of a surface layer 106, a Quaternary aquifer 105 and a weathered bedrock aquifer 104 from top to bottom. Moreover, below the weathered bedrock aquifer 104, there are a coal seam 101 and a goaf 102. During the mining process, due to a high-intensity mining of the coal, a development height of a water conducting fracture zone 103 may be increased, which may make the water conducting fracture zone 103 develop to the weathered bedrock aquifer 104, causing the Quaternary aquifer 105 to connect the weathered bedrock aquifer 104 and the water conducting fracture zone 103. In this case, groundwater may flow into the goaf 102, resulting in a sharp increase in mine water inflow, which may pose a great threat to the safety of coal mines.

At present, there are two kinds of water prevention and control measures for coal seam roof. One is to optimize and adjust the mining process of the working face, such as height limiting mining, to limit the developments of water conducting fracture zones. The other is to repair the aquifer of the coal seam roof through grouting reinforcement, or to block or fill the water conducting fracture zones with artificial water barriers. Ground grouting technology is divided into a vertical hole grouting and a horizontal hole grouting according to the drilling process. Horizontal hole grouting is widely used due to its wide diffusion area and uniform permeability, as well as the maturity of flexible drilling equipment nowadays. However, due to the limitations of flexible drilling equipment, a curvature radius of a borehole of a current branching borehole is mostly around 10 m. Moreover, there is no effective solution for drilling a branching borehole with a short vertical distance and a short curvature radius.

It should be noted that the curvature radius of a branching borehole with a short radius is usually less than 19.1 m, such as 15.0 m, 10.0 m, 7.2 m, 5.0 m, and etc. Furthermore, a branching borehole with a curvature radius less than 5.73 m can be referred to as an ultra-small radius branching borehole, such as one with a curvature radius of 4.2 m. The vertical distance of a branching borehole with a short vertical distance is usually less than 10 meters, such as 6.5 meters, 8.2 meters, etc.

In view of this, examples of the present disclosure provide a directional drilling method and a directional drilling system for a branching borehole with a short vertical distance and a short radius. The directional drilling method may include: obtaining geological data; determining a lateral drilling point and a target point of a branching borehole; drawing a target borehole trajectory of the branching borehole based on the lateral drilling point and the target point; obtaining parameters of the drill pipe; determining a propulsion force corresponding to the target borehole trajectory based on the parameters, the target borehole trajectory, and the geological data; and applying the propulsion force to the rigid bending joint directional drilling device for drilling the branching borehole. The propulsion force may cause the wedge deflection tool of the rigid bending joint directional drilling device to receive a contact reaction force perpendicular to an axis of the drilling device from a drilling wall, so as to bend the rigid bending joint guiding unit. In this way, a branching borehole with a short vertical distance and a short curvature radius can be obtained. It can be seen that, the difficulty in drilling an inclined section with a short vertical distance and a short radius can be overcome.

In the following, technical solutions of the directional drilling method for a branching borehole with a short vertical distance and a short radius will be further explained in detail through specific examples and drawings.

FIG. 1 is a diagram illustrating an application scenario of a directional drilling 100 of a branching borehole with a short vertical distance and a short radius according to an example of the present disclosure.

At first, a geological condition survey of the mining area should be conducted. In examples of the present disclosure, the geological condition survey may include: investigating a spatial distribution and water abundance of the Quaternary aquifer 105, the weathered bedrock aquifer 104, and water conducting fracture zone 103 located below the surface layer 106; determining an approximate area where the water conducting fracture zone 103 develops into the weathered bedrock aquifer 104; and exploring a hydraulic connection between the Quaternary aquifer 105 and the weathered bedrock aquifer 104. Where, the weathered bedrock aquifer 104 is located below the Quaternary aquifer 105.

In some examples, some physical parameters such as a depth of the Quaternary aquifer 105, a depth of the weathered bedrock aquifer 104, a thickness of a strata on the roof and a friction coefficient can be obtained through relevant drilling data, indoor mechanical tests and other methods.

In some examples, it can be determined whether there is overflow recharge from the Quaternary aquifer 105 to the weathered bedrock aquifer 104, and whether the water in the Quaternary aquifer 105 will overflow to the weathered bedrock aquifer 104 based on a geophysical exploration, a drilling exploration, a transient electromagnetic measurement, a groundwater flow rate detection, and/or a groundwater flow direction detection. At the same time, it can also be determined whether the water conducting fracture zone 103 has developed into the weathered bedrock aquifer 104, whether the water conducting fracture zone 103 has become a strong water conducting channel connecting the weathered bedrock aquifer 104 and the Quaternary aquifer 105, and whether groundwater can flow into the goaf 102 along the water conducting fracture zone 103 which may cause a large amount of water inflow in the goaf 102.

It can be seen that geological data can be obtained based on the geological condition survey. Moreover, based on the geological data, the risk of water inrush in the goaf 102 can be determined. Here, those skilled in the art can choose appropriate analysis methods based on actual situations and determine the risk of water inrush based on the geological data. The analysis methods taken should not be limited by examples of the present disclosure.

When it is determined that there is a risk of water inrush, using ultra-small radius branching borcholes for grouting at the bottom interface of the weathered bedrock aquifer 104 on the roof of the coal seam may be an effective solution to avoid water inrush problems.

Figure 2:
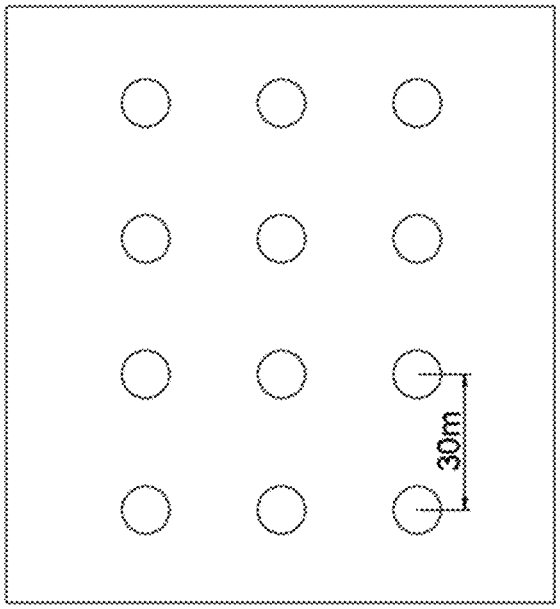
FIG. 2 is a schematic diagram illustrating an application scenario of a layout of main holes on the ground according to an example of the present disclosure.

As shown in FIG. 1, based on the geological data, locations of at least one vertical well 108 (also called as a main hole) drilled in the surface layer 106 and a location of a bottom of the at least one vertical well 108 can be determined. For example, FIG. 2 shows a schematic diagram of a layout of main holes on the ground according to an example of the present disclosure. It can be seen from FIG. 2 that multiple vertical wells can be arranged in a matrix. According to the layout, a spacing of 30 m between two adjacent vertical wells 108 may be set. Moreover, the location of the bottom of each vertical well 108 may be set in the weathered bedrock aquifer 104, which is 4-6 m below the bottom of the weathered bedrock aquifer 104.

Next, based on the geological data, a lateral drilling point and a target point of a branching borehole 107 with a short radius may be determined. Here, the lateral drilling point may be at the bottom of the vertical well 108. The target point may be located at or below the top of the water conducting fracture zone 103 to facilitate grouting into the fractures. Alternatively, the bottom of the vertical well may be connected to at least two branching boreholes 107 with short radius, which may be symmetrically distributed with a central axis of the vertical well 108. This distribution may help to improve a utilization rate of the vertical well 108.

It should be understood that the borehole trajectory of a branching borehole 107 with a short radius may be limited by a performance of a flexible drilling tool. In order to ensure a drilling process of the branching borehole with a short radius, examples of the present disclosure provide a rigid bending joint directional drilling device, which can drill horizontal holes with a curvature radius less than 10 m, such as 6 m, 5 m, 4 m, or 3 m.

Figure 3:
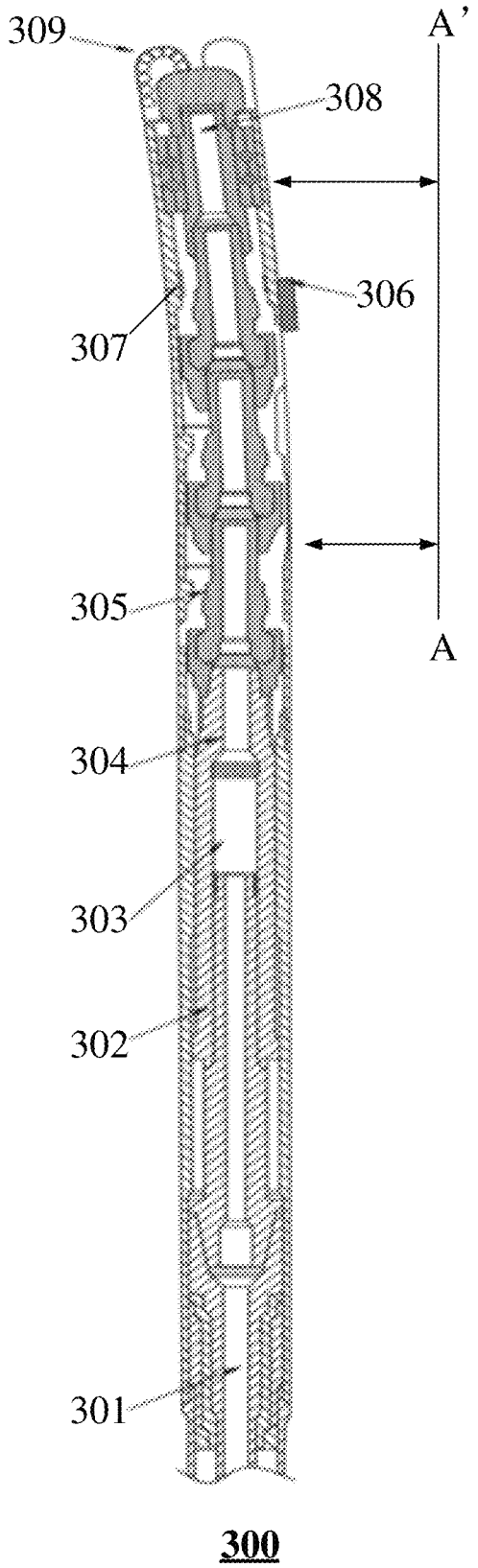
FIG. 3 is a schematic diagram illustrating a structure of the rigid bending joint directional drilling device according to an example of the present disclosure.

FIG. 3 is a schematic diagram illustrating a structure of the rigid bending joint directional drilling device 300 according to an example of the present disclosure. In some examples, the rigid bending joint directional drilling device 300 can be driven by high-pressure drilling fluid.

In some examples, the rigid bending joint directional drilling device 300 may include a screw drill 301, a transmission mandrel 302, a measuring nipple 303, a first conversion joint 304, a rigid bending joint guiding unit, a second conversion joint 308, and a drill bit 309, which are connected by plugging. It should be noted that the rigid bending joint guiding unit may have an initial arc shape. Referring to FIG. 3, it can be seen that the rigid bending joint guiding unit may move gradually away from a straight line A-A'.

Furthermore, the rigid bending joint guiding unit may include at least one drill pipe 305, a bendable outer wall (not labeled in the figure) and a wedge deflection tool 306. Here, the drill pipe 305 may be made of rigid material. Adjacent drill pipes 305 may be connected by connecting pieces. At the connection points, adjacent drill pipes 305 can be relatively deflected to bend on the basis of rigidity. In this way, a flexible drilling tool can be obtained. The wedge deflection tool 306 may be applied at an end of the bendable outer wall near the drill bit 309. Optionally, the wedge deflection tool 306 may refer to a gasket with a certain thickness. In this way, the bendable outer wall can bend with the rigid bending joint guide unit but does not rotate around its axis. The wedge deflection tool 306 can receive a contact reaction force perpendicular to an axis direction of the bendable outer wall from the drilling wall continuously. This contact reaction force may act on the rigid bending joint guide unit, making it further bend beyond the initial arc. A propulsion force from the rig on the drill pipe may be positively correlated with the curvature of the borehole, which makes a directional drilling with controllable radius possible.

In some examples of the present disclosure, the rigid bending joint directional drilling device 300 may further include: a positioning component 307. The positioning component 307 may be disposed on the bendable outer wall near the drill bit 309. The positioning component 307 can be used to collect position information of an end of the rigid bending joint directional drilling device. The positioning component 307 may transmit the position information to a processor for processing through the measuring nipple 303. For example, the position information can be GPS information and etc.

It should be understood that after determining the rigid bending joint directional drilling device, parameters of the device can be obtained. The parameters may include but not limited to a length, a weight, a bending stiffness of the drill pipe, and a rated curvature radius of the rigid bending joint guide unit.

Then, a target borehole trajectory of a branching borehole may be drawn according to the lateral drilling point and the target point based on the parameters of the device.

Figure 4:
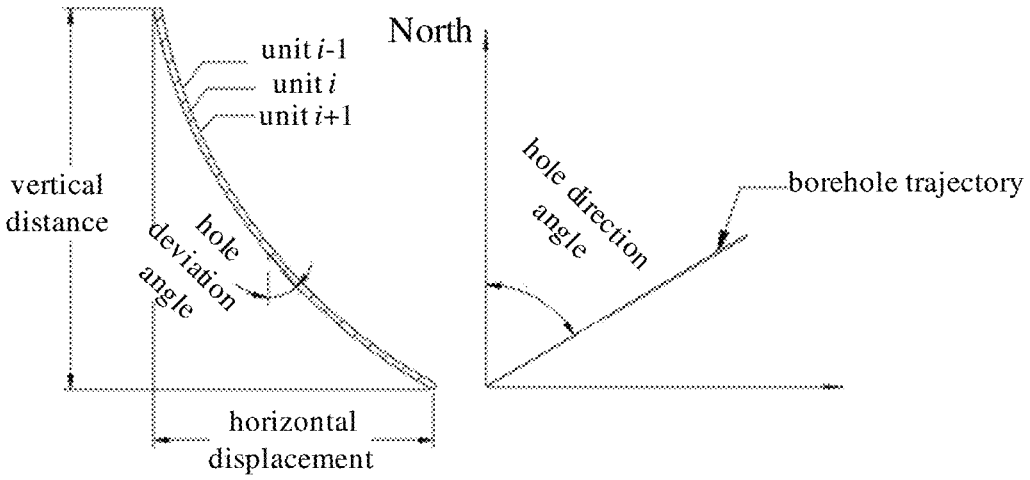
FIG. 4 is a schematic diagram illustrating some parameters of a borehole trajectory of a branching borehole according to an example of the present disclosure.

FIG. 4 is a schematic diagram illustrating some parameters of a borehole trajectory of a branching borehole according to an example of the present disclosure. As shown on a left side of FIG. 4, a vertical distance may refer to a length of the borehole trajectory of the branching borehole in a vertical direction. A horizontal displacement may refer to a length of the borehole trajectory in a horizontal direction. The hole deviation angle may refer to an angle between a tangent direction of any point on the borehole trajectory and a vertical line. As shown on the right side of FIG. 4, the hole direction angle may refer to an angle between an orthographic projection of the borehole trajectory on a horizontal plane and a north direction. It should be noted that the parameters of the borehole trajectory mentioned above are not only applicable to the target borehole trajectory, but also to a predicted borehole trajectory or a drilling trajectory.

In some examples of the present disclosure, a minimum value of the curvature radius of the target borehole trajectory should not less than a preset threshold, and a hole deviation angle at a target point of the target borehole trajectory should satisfy a preset condition.

In some examples of the present disclosure, the preset threshold is not less than a rated curvature radius of the rigid bending joint directional drilling device. For example, the preset threshold can be set as the rated curvature radius of the rigid bending joint directional drilling device, or it can be set as a value greater than the rated curvature radius of the rigid bending joint directional drilling device. Through such a configuration, it can ensure that an actual borehole trajectory obtained by the rigid bending joint directional drilling device while drilling roughly conforms to the target borehole trajectory, avoiding a construction failure due to an actual curvature radius exceeds the rated curvature radius of the rigid bending joint directional drilling device.

In some examples of the present disclosure, the preset condition may be set as being 90° or corresponding to a dip angle of a formation where the target point is located. Here, the preset condition may be set as a complementary of the dip angle of the formation or being identical to the dip angle of the formation. This configuration can make the tangent of the borehole trajectory at the target point parallel to the formation, which is beneficial for the grout to flow along the formation while grouting.

Next, construction parameters may be determined based on the target borehole trajectory. In some examples, a curvature data set of predicted borehole trajectories under several preset initial propulsion forces and preset initial hole deviation angles under the formation conditions may be obtained through theoretical calculation formulas. Then a range of the propulsion force of the drill pipe required to fit the target borehole trajectory can be finally determined.

The parameters involved in the above theoretical calculations formulas may include but not be limited to the length, the weight, the bending stiffness of the drill pipe and the friction coefficient of the formation. It should be noted that the above parameters can be obtained by the rigid bending joint directional drilling device through the geological condition survey.

In some examples, the theoretical calculations may adopt finite element analysis. The target borehole trajectory may be divided into multiple segments, with each segment being as small as possible. For example, referring to FIG. 4, based on the formation information, the target borehole trajectory may be divided into at least one unit group. Here, one formation can correspond to one unit group, or one formation can correspond to multiple unit groups. Next, each unit group may be further divided into at least one unit based on the length of the drill pipe. Here, the deflection at the connections of multiple drill pipes is the basis for achieving a directional drilling of a branching borehole, so the unit group can be divided based on the length of the drill pipe.

It should be noted that, as shown in FIG. 4, a certain unit can be represented by i, where the unit closer to the lateral drilling point has a smaller ranking, for example, the unit before i can be represented by i−1. The unit closer to the target point has a higher ranking, for example, the unit after i can be represented by i+1.

Figure 5:
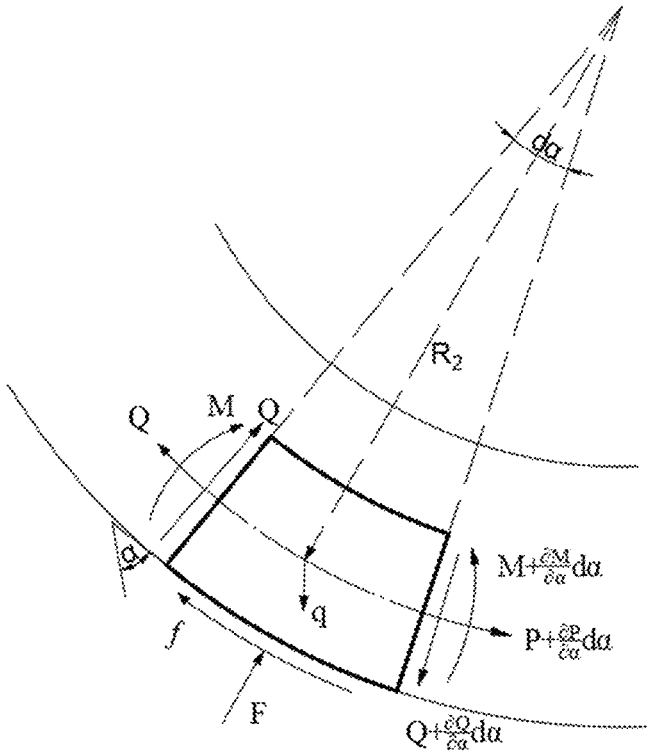
FIG. 5 is a force analysis schematic diagram of the drill pipe according to an example of the present disclosure.

FIG. 5 is a force analysis schematic diagram of the drill pipe according to an example of the present disclosure. As shown in FIG. 5, in a drilling direction, the drill pipe may be subjected to a frictional force f. Moreover, in a direction perpendicular to an axis of the drill pipe, the drill pipe may be subjected to a contact reaction force F. For a rigid bending joint directional drilling device, the contact reaction force F may act on the wedge deflection tool 306.

Based on the above force analysis, starting from the lateral drilling point, the contact reaction force F subjected to unit i may be calculated by the following formulas (1) to (3):

$$F_i = \frac{2q_i(R_2)i}{1+\mu_i^2}\left[\cos\alpha_i - \cos\alpha_{i-1} \pm \mu_i^2(-\sin\alpha_{i-1} + \sin\alpha_i)\right] \pm A_i(e^{\pm\mu_i\alpha_i} - e^{\pm\mu_i\alpha_{i-1}}) \tag{1}$$

$$A_i = \left\{P_{i-1} - \frac{q_i(R_2)i}{1+\mu_i^2}\left[(\mu_i^2-1)\sin\alpha_{i-1} \pm 2\mu_i\cos\alpha_{i-1}\right]\right\}\frac{1}{e^{\pm\mu_i\alpha_{i-1}}} \tag{2}$$

$$P_i = A_i e^{\pm\mu_i\alpha_i} + \frac{q_i(R_2)i}{1+\mu_i^2}\left[(\mu_i^2-1)\sin\alpha_i \pm 2\mu_i\cos\alpha_i\right] \tag{3}$$

Where, $\alpha$ refers to the hole deviation angle. $\mu_i$ refers to the formation friction coefficient. $q_i$ refers to the weight of a unit of the drill pipe. If a unit corresponds to a drill pipe, $q_i$ may refer to the weight of the drill pipe. $R_2$ refers to the curvature radius of the central axis of the drill pipe. P refers to the propulsion force.

In a virtual equivalent calculation method, the contact reaction force of a previous unit can be used to approximate the contact reaction force of the current unit. In this way, a calculated hole deviation angle and a deflection of the current unit can be obtained.

$$\alpha_{i+1} = \frac{\pi}{2} - \frac{F_i l^2}{2EI} + \alpha_i \tag{4}$$

$$w_{i+1} = \frac{F_i l^3}{3EI} \tag{5}$$

Where, El refers to the bending stiffness of the drill pipe, which is a constant; F refers to the contact reaction force; and l refers to the length of a unit, such as the length of a drill pipe.

For example, as shown in FIG. 5, $R_2$ can be approximated to a curvature radius of a circular arc based on the bending curve of a drill pipe. For example, $R_2$ can be calculated by the following method.

At first, a coordinate system can be established with an end of unit i adjacent to a previous unit i−1 as the origin and a direction of the unit i when it is not bent as the x-axis. Within the range of $0 \le x \le l$, $y = F_{i-1}lx^2/2E - F_{i-1}x^3/6EI$. When x=l, y may be the calculated deflection described above.

Then, the bending curve of the drill pipe may be approximated as a circular arc. Three coordinate points (A, B, C) can be taken to calculate the radius of the circular arc. The calculation method may include: calculating distances $D_{AB}$, $D_{BC}$ and $D_{CA}$ between the coordinate points A and B, the coordinate points B and C, the coordinate points C and A; calculating a half circumference of the triangle $S=(D_{AB}+D_{BC}+D_{CA})/2$; calculating an area of the triangle $\text{area}=(S(S-D_{AB})(S-D_{AB})(S-D_{AB}))^{1/2}$; and determining the radius of the circular arc as $R2=(D_{AB}\cdot D_{AB}\cdot D_{AB})/(4\text{area})$.

Based on a preset initial propulsion force and a preset initial hole deviation angle, the contact reaction force F, the calculated propulsive force, the calculated hole deviation angle, and the calculated deflection of each unit can be calculated. Then a predicted borehole trajectory according to one preset initial propulsion force and one preset initial hole deviation angle can be plotted.

Specifically, for unit i, by substituting $P_{i-1}$ and $\alpha_{i-1}$ into formula (2), $A_i$ can be calculated. By substituting $A_i$ into formula (3) the propulsive force $P_i$ can be calculated. Here, $P_i$ can be further used to calculate $A_{i+1}$. Further, by substituting $\alpha_{i-1}$, $\alpha_i$, and $A_i$ into formula (1), the contact reaction force $F_i$ of unit i can be calculated. Here, $\alpha_{i-1}$ and $\alpha_i$ can be calculated in a previous unit or be the preset hole deviation angle. By substituting $F_i$ into formula (4) and (5), $\alpha_{i+1}$ and $w_{i+1}$ of unit i+1 can be calculated. It should be noted that for the first unit, $P_0$ may be set as the preset initial propulsion force, $\alpha_0$ and $\alpha_1$ may be set as the preset initial hole deviation angle. For example, the preset initial hole deviation angle can be determined based on an initial arc of the end of the rigid bending joint directional drilling device, or it can be set to 0.

By calculating $\alpha_{i+1}$ and $w_{i+1}$ for each unit in turn, the predicted borehole trajectory can be plotted gradually. Alternatively, using a computer program such as MATLAB, the recursive calculations can be performed and the predicted borehole trajectory can be plotted after entering relevant parameters (such as a preset initial propulsion force).

One would understand that different predicted borehole trajectories can be obtained for different preset initial propulsion forces and different preset initial hole deviation angles.

Then, by comparing the target borehole trajectory with different predicted borehole trajectories, a predicted borehole trajectory that matches the target borehole trajectory may be selected as a candidate borehole trajectory. It should be noted that the predicted borehole trajectory that matches the target borehole trajectory does not need to completely overlap with the target borehole trajectory. The predicted borehole trajectory that matches the target borehole trajectory first needs to have the same lateral drilling point and the same target point. Moreover, a minimum curvature radius of the predicted borehole trajectory that matches the target borehole trajectory must be not less than a preset threshold, and the hole deviation angle of the target point must meet a preset condition.

Finally, the preset initial propulsion force corresponding to the candidate borehole trajectory and the calculated propulsion force of each unit determined according to the preset initial propulsion force may be taken as the propulsion forces corresponding to the target borehole trajectory. During a construction process, the rigid bending joint directional drilling device may be applied with the preset initial propulsion force and the calculated propulsion force of each unit.

In some examples of the present disclosure, based on the position information from the positioning component, the position of the drill bit and a corresponding calculated propulsion force can be determined. It should be understood that based on the position information, the hole deviation angle, the hole direction angle, the horizontal position, the vertical distance, and etc. can be determined. Based on these parameters, a drilling trajectory can be depicted.

Furthermore, appropriate measures can be taken to adjust the drill rig and change the propulsion force of the drill pipe to maintain the direction and the angle of the borehole in response to determining that the drilling trajectory deviates from the target borehole trajectory by comparing the drilling trajectory with the target borehole trajectory.

By adopting the above-mentioned technical scheme, an average deflection rate of the branching borehole may be 13-17°/m, and an average curvature radius of each branching borehole may be around 5 m.

As disclosed above, examples of the present disclosure provide a simple and flexible drilling tool for drilling branching boreholes with a large curvature. By calculating and simulating the borehole trajectory through theoretical formulas, a range of the propulsion force required while drilling the formation can be determined. In this way, a breakthrough without any deflector, casing, or sidetracking in a vertical hole can be achieved. Branching borcholes with a short vertical distance and a large curvature can be obtained. The curvature radius of each horizontal branching borehole can be around 5 m, which solves the problems of current side-drilling technologies.

Next, an example would be described in detail to further illustrate the above drilling method. In this example, a bottom interface of a weathered bedrock aquifer in a mining area of an Ordos coalfield would be grouted. The geological conditions of this coalfield include thin bedrock and thick loose layers, which make drilling branching borcholes with a short vertical distance and a short radius in the bedrock a challenge.

A grouting area may be determined based on the geological data at first. Then, a layout vertical wells as shown in FIG. 2 may be designed. Moreover, the target borehole trajectory of the branching boreholes and the corresponding propulsion forces may be determined.

As shown in FIG. 1, a vertical well 108 may be drilled from the surface layer in this area. The bottom of the vertical well 108 may locate in the weathered bedrock aquifer 104, which is of a 4-6 m distance from the bottom of the weathered bedrock aquifer. Grouting may be performed when drilling completes.

In some examples, a drilling tool of the vertical well may include a hard alloy drill bit, a straight screw, a drill pipe, and a drill bit.

Furthermore, in the drilling process of the vertical hole, a pump pressure may be controlled at 10-12 MPa, a rate of a water pump may be controlled as 8.3-10 L/s. When the pump pressure is reduced by 2-3 MPa in the broken rock layer or leakage section, the rate of the water pump may be controlled as 2.5-3.3 L/s.

As an example, an entire construction process may adopt a three-spud process. For vertical wells, to prevent drilling from polluting the surface water source in the phreatic layer, a 215 mm drill bit may be used to perform the first spud. Then, a casing of N80 Steel with 168 mm may be used to seal the soft and leaky upper strata to isolate the underground drinking shallow water layer. High-grade 42.5 Portland cement with a cement slurry density of 1.6-1.65 g/cm3 may be used for grouting. After the cement slurry returns to the surface, the second spud is performed using a quasi-152 mm drill bit to the weathered bedrock aquifer. The well depth is of 95 m. A casing of J55 Steel with 177.8 mm may be used to seal the aquifer. High-grade 32.5 Portland cement with a cement slurry density of 1.65-1.7 g/cm3 may be used for grouting.

Furthermore, an optical fiber hole gyroscope inclinometer may be used for inclinometry. When drilling the vertical well, measuring points are set every 10 meters (to detect whether there is a hole collapse in the borehole). Moreover, measurements are taken every 30-50 minutes (to check whether there is a deviation in the vertical well). Here, measuring points are set every 10 meters. In actual applications, the number of measuring points can be increased as needed. In response to determining that there is no deviation in the vertical well after measurements, drilling would be continued. Otherwise, the drilling direction would be adjusted to eliminate the deviation.

Next, a flexible drilling tool, such as the rigid bending joint directional drilling device disclosed, may be used for deflection. For example, through theoretical calculations, if the vertical distance is about 0-3 m, the pressure of the propulsion force would be roughly 4-6 MPa. If the vertical distance is about 3-4.5 m, the pressure of the propulsion force would be roughly 6-8 MPa. Moreover, if the vertical distance is about 4.5-6.5 m, the pressure of the propulsion force would be roughly 8-12 MPa.

Specifically, the flexible drilling tool may be lowered into the vertical well 108. When it reaches the bottom of the vertical well 108, a short radius branching borehole 107 may be constructed downward. The top of the small radius branching borehole 107 may be located in the weathered bedrock aquifer 104, and the bottom of the small radius branching borehole 107 may be located at or below the top of the water-conducting fracture zone 103. When the well deviation angle of the small radius branching borehole 107 is 90° or when the small radius branching borehole 107 is parallel to the formation, drilling can be stopped. After the drill tool is lifted, grouting may be performed.

The process of drilling a branching borehole may correspond to the third spud. In this process, a quasi-133 mm drill bit can be used for a directional drilling along the pre-deployed trajectory.

During the entire drilling process, the well deviation angle and the hole direction angle are monitored continuously to ensure that the borehole remains near the target borehole trajectory. Real-time data provided by the positioning component and the measuring nipple may be used to plot a drilling trajectory. When the drilling trajectory deviates from the target borehole trajectory, appropriate measures can be taken to adjust the drill rig and change the propulsion force of the drill pipe to maintain the direction and angle of the borehole.

It should be noted that the method according to examples of the present disclosure may be performed by a single device, such as a computer or server. Moreover, the method according to examples of the present disclosure can also be applied to a distributed scenario, where the method can be implemented through cooperation of multiple devices. In the case of such a distributed scenario, one device of the plurality of devices may only perform one or more steps of the method, and the plurality of devices may interact with each other to perform the described method.

It is noted that some examples of the present disclosure have been described above. Other examples are within the scope of the following claims. In some cases, the acts or steps recited in the claims may be performed in a different order than in the examples described above and can still achieve desirable results. Additionally, the processes depicted in the accompanying drawings do not necessarily require the particular order shown, or sequential order, to achieve desirable results. In some examples, multi-tasking and parallel processing are also possible or may be advantageous.

Based on a same concept, the directional drilling system for a branching borehole with a short vertical distance and a short radius according to the present disclosure may include: a rigid bending joint directional drilling device and a processor.

As shown in FIG. 3, the rigid bending joint directional drilling device 300 may include: a wedge deflection tool and a rigid bending joint guiding unit. The rigid bending joint guide unit may include a drill pipe. The wedge deflection tool may be used to receive a contact reaction force perpendicular to a drilling wall from an axial direction of the rigid bending joint directional drilling device and to bend the rigid bending joint guiding unit.

The processor is configured to obtain geological data; determine a lateral drilling point and a target point of a branching borehole based on the geological data; draw a target borehole trajectory of the branching borehole based on the lateral drilling point and the target point; where, a minimum value of the curvature radius of the target borehole trajectory is not less than a preset threshold, and a hole deviation angle at the target point of the target borehole trajectory satisfies a preset condition; obtain parameters of the drill pipe; determine a propulsion force corresponding to the target borehole trajectory based on the parameters, the target borehole trajectory, and the geological data; and applying the propulsion force to the rigid bending joint directional drilling device for drilling the branching borehole; where, the propulsion force is converted into the contact reaction force.

Examples of the present disclosure provide a directional drilling method. The directional drilling method may be applied to a rigid bending joint directional drilling device 300. As shown in FIG. 3, the rigid bending joint directional drilling device 300 may include: a wedge deflection tool and a rigid bending joint guiding unit. The rigid bending joint guide unit may include a drill pipe. The wedge deflection tool may be used to receive a contact reaction force perpendicular to a drilling wall from an axial direction of the rigid bending joint directional drilling device and to bend the rigid bending joint guiding unit.

As shown in FIG. 1, the directional drilling method may include the following steps: obtaining geological data; determining a lateral drilling point and a target point of a branching borehole based on the geological data; drawing a target borehole trajectory of the branching borehole based on the lateral drilling point and the target point; where, a minimum value of the curvature radius of the target borehole trajectory is not less than a preset threshold, and a hole deviation angle at the target point of the target borehole trajectory satisfies a preset condition; obtain parameters of the drill pipe; determining a propulsion force corresponding to the target borehole trajectory based on the parameters, the target borehole trajectory, and the geological data; and applying the propulsion force to the rigid bending joint directional drilling device for drilling the branching borehole; where, the propulsion force is converted into the contact reaction force.

In some examples of the present disclosure, the rigid bending joint directional drilling device 300 may further include: a positioning component 307. The directional drilling method may further include the following steps: obtaining positioning information from the positioning component 307; determining a drilling trajectory of the branching borehole according to the positioning information; comparing the drilling trajectory with the target borehole trajectory; in response to determining that the drilling trajectory deviates from the target borehole trajectory, adjusting the propulsion force acted on the rigid bending joint directional drilling device 300 according to the drilling trajectory.

In some examples of the present disclosure, the directional drilling method may further include: as shown in FIG. 1, drilling a vertical well from the surface layer downward; where, the bottom of the vertical well corresponds to the lateral drilling point.

In some examples of the present disclosure, the preset threshold is not less than a rated curvature radius of the rigid bending joint directional drilling device. In some examples of the present disclosure, the preset condition may be set as being 90° or corresponding to a dip angle of a formation where the target point is located.

In some examples of the present disclosure, a curvature radius of a branching borehole with a short radius may be less than 6 meters. In some examples of the present disclosure, an average deflection rate of a branching borehole with a short radius may be 13-17°/m.

In some examples of the present disclosure, a pressure of the propulsion force may be 4-12 MPa.

In some examples, the geological data may include formation information and a friction coefficient of each formation. The parameters may include a length, a weight and a bending stiffness.

In some examples of the present disclosure, the step of determining a propulsion force corresponding to the target borehole trajectory may include the following steps.

First, as shown in FIG. 4, dividing the target borehole trajectory into at least one unit group based on the formation information; and dividing each unit group into at least one unit based on the length of the drill pipe, for example unit i and unit i+1.

Then, taking one by one of the at least one unit as a target unit; determining the calculated hole deviation angle and the calculated deflection corresponding to the target unit based on the preset initial propulsion force, the preset initial hole deviation angle, the length, the weight, the bending stiffness, and the corresponding friction coefficient of the formation; and drawing a predicted borehole trajectory based on the calculated hole deviation angle and the calculated deflection. For example, calculations may be done according to the formulas (1) to (5).

Later, comparing the target borehole trajectory with different predicted borehole trajectories corresponding to different preset initial propulsion forces and different preset initial hole deviation angles; selecting a predicted borehole trajectory that matches the target borehole trajectory as a candidate borehole trajectory; and taking the preset initial propulsion force corresponding to the candidate borehole trajectory and the calculated propulsion force of each unit determined according to the preset initial propulsion force as the propulsion forces corresponding to the target borehole trajectory.

In some examples of the present disclosure, the step of determining the calculated hole deviation angle and the calculated deflection corresponding to the target unit based on the preset initial propulsion force, the preset initial hole deviation angle, the length, the weight, the bending stiffness, and the corresponding friction coefficient of the formation may include: calculating the calculated hole deviation angle of the target unit based on the contact reaction force of a previous target unit, the calculated hole deviation angle of the previous target unit, the length and the bending stiffness of the previous target unit; calculating the contact reaction force and the propulsion force of the target unit based on the calculated propulsion force of the previous target unit, the calculated hole deviation angle of the previous target unit, the calculated hole deviation angle of the target unit, the weight of the target unit, and the corresponding friction coefficient of the formation; and determining the calculated deflection of the target unit based on the contact reaction force of the previous target unit, the length, and the bending stiffness of the previous target element.

In some examples of the present disclosure, in response to determining the target unit is a first unit, the hole deviation angle of the previous target unit and the hole deviation angle of the target unit are set as the preset initial hole deviation angle; and the calculated propulsion force of the previous target unit is set as the preset initial propulsion force.

From the above descriptions, it can be seen that the directional drilling method and the directional drilling system provided by examples of the present disclosure may obtain geological data, determine a lateral drilling point and a target point of a branching borehole; draw a target borehole trajectory of the branching borehole based on the lateral drilling point and the target point; obtain parameters of the drill pipe; determine a propulsion force corresponding to the target borehole trajectory based on the parameters, the target borehole trajectory, and the geological data; and applying the propulsion force to the rigid bending joint directional drilling device for drilling the branching borehole. The propulsion force may cause the wedge deflection tool of the rigid bending joint directional drilling device to receive a contact reaction force perpendicular to an axis of the rigid bending joint directional drilling device from a drilling wall, so as to bend the rigid bending joint guiding unit. In this way, a branching borehole with a short vertical distance and a small curvature radius can be obtained. It can be seen that, the difficulty in drilling an inclined section with a short vertical distance and a short radius can be overcome.

Those of ordinary skill in the art should appreciate that the discussion on any one of the foregoing examples is merely exemplary, but is not intended to imply that the scope of the present disclosure (including the claims) is limited to these examples. Under the idea of the present disclosure, the technical features of the foregoing examples or different examples may be combined, the steps may be implemented in any order, and there are many other variations in different aspects of the examples of the present disclosure, all of which are not provided in detail for simplicity.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A directional drilling method for a branching borehole with a short radius and a short vertical distance, applied to a rigid bending joint directional drilling device; wherein the rigid bending joint directional drilling device comprises: a wedge deflection tool and a rigid bending joint guiding unit; the rigid bending joint guide unit comprises a drill pipe; the wedge deflection tool is configured to receive a contact reaction force perpendicular to a drilling wall from an axial direction of the rigid bending joint directional drilling device and to bend the rigid bending joint guiding unit;

the directional drilling method comprises:

obtaining geological data;

determining a lateral drilling point and a target point of a branching borehole based on the geological data;

drawing a target borehole trajectory of the branching borehole based on the lateral drilling point and the target point; wherein, a minimum value of the curvature radius of the target borehole trajectory is not less than a preset threshold, and a hole deviation angle at the target point of the target borehole trajectory satisfies a preset condition;

obtaining parameters of the drill pipe;

determining a propulsion force corresponding to the target borehole trajectory based on the parameters, the target borehole trajectory, and the geological data; and applying the propulsion force to the rigid bending joint directional drilling device for drilling the branching borehole; wherein, the propulsion force is converted into the contact reaction force;

wherein, the geological data comprises: formation information and a friction coefficient of each formation;

the parameters of the drill pipe comprise: a length, a weight and a bending stiffness of the drill pipe;

determining a propulsion force corresponding to the target borehole trajectory based on the parameters, the target borehole trajectory, and the geological data comprises:

dividing the target borehole trajectory into at least one unit group based on the formation information;

dividing each unit group into at least one unit based on the length of the drill pipe;

taking one by one of the at least one unit as a target unit;

determining a calculated hole deviation angle and a calculated deflection corresponding to the target unit based on a preset initial propulsion force, a preset initial hole deviation angle, the length, the weight, the bending stiffness of the drill pipe, and the corresponding friction coefficient of the formation; drawing a predicted borehole trajectory based on the calculated hole deviation angle and the calculated deflection;

comparing the target borehole trajectory with different predicted borehole trajectories corresponding to different preset initial propulsion forces and different preset initial hole deviation angles;

selecting a predicted borehole trajectory that matches the target borehole trajectory as a candidate borehole trajectory; and taking the preset initial propulsion force corresponding to the candidate borehole trajectory and the calculated propulsion force of each unit determined according to the preset initial propulsion force as the propulsion forces corresponding to the target borehole trajectory.

2. The directional drilling method of claim 1, wherein, the rigid bending joint directional drilling device further comprises: a positioning component;

the directional drilling method further comprises:

obtaining positioning information from the positioning component;

determining a drilling trajectory of the branching borehole according to the positioning information;

comparing the drilling trajectory with the target borehole trajectory; and in response to determining that the drilling trajectory deviates from the target borehole trajectory, adjusting the propulsion force acted on the rigid bending joint directional drilling device according to the drilling trajectory and the target borehole trajectory.

3. The directional drilling method of claim 1, wherein, the directional drilling method further comprises: drilling a vertical well from the surface layer downward; wherein, the bottom of the vertical well corresponds to the lateral drilling point.

4. The directional drilling method of claim 1, wherein, the preset threshold is not less than a rated curvature radius of the rigid bending joint directional drilling device; and/or the preset condition is set as being 90° or corresponding to a dip angle of a formation where the target point is located.

5. The directional drilling method of claim 1, wherein, a curvature radius of the branching borehole is less than 6 meters; and/or an average deflection rate of the branching borehole is 13-17°/m.

6. The directional drilling method of claim 1, wherein, a pressure of the propulsion force is 4-12 MPa.

7. The directional drilling method of claim 1, wherein, taking one by one of the at least one unit as a target unit and determining a calculated hole deviation angle and a calculated deflection corresponding to the target unit based on a preset initial propulsion force, a preset initial hole deviation angle, the length, the weight, the bending stiffness of the drill pipe, and the corresponding friction coefficient of the formation comprises:

calculating the contact reaction force and the propulsion force of the target unit based on the calculated propulsion force of the previous target unit, the calculated hole deviation angle of the previous target unit, the calculated hole deviation angle of the target unit, the weight of the target unit, and the corresponding friction coefficient of the formation;

calculating the calculated hole deviation angle of a next target unit based on the contact reaction force of the target unit, the calculated hole deviation angle of the target unit, the length and the bending stiffness of the target unit; and determining the calculated deflection of the next target unit based on the contact reaction force of the target unit, the length, and the bending stiffness of the target unit.

8. The directional drilling method of claim 7, wherein, in response to determining the target unit is a first unit, the hole deviation angle of the previous target unit and the hole deviation angle of the target unit are set as the preset initial hole deviation angle; and the calculated propulsion force of the previous target unit is set as the preset initial propulsion force.

9. A directional drilling system for a branching borehole with a short radius and a short vertical distance, comprising:

a rigid bending joint directional drilling device and a processor; wherein, the rigid bending joint directional drilling device comprises: a wedge deflection tool and a rigid bending joint guiding unit; the rigid bending joint guide unit comprises a drill pipe; the wedge deflection tool is configured to receive a contact reaction force perpendicular to a drilling wall from an axial direction of the rigid bending joint directional drilling device and to bend the rigid bending joint guiding unit; and the processor is configured for:

obtaining geological data;

determining a lateral drilling point and a target point of a branching borehole based on the geological data;

drawing a target borehole trajectory of the branching borehole based on the lateral drilling point and the target point; wherein, a minimum value of the curvature radius of the target borehole trajectory is not less than a preset threshold, and a hole deviation angle at the target point of the target borehole trajectory satisfies a preset condition;

obtaining parameters of the drill pipe;

determining a propulsion force corresponding to the target borehole trajectory based on the parameters, the target borehole trajectory, and the geological data; and applying the propulsion force to the rigid bending joint directional drilling device for drilling the branching borehole; wherein, the propulsion force is converted into the contact reaction force;

wherein, the geological data comprises: formation information and a friction coefficient of each formation;

the parameters of the drill pipe comprise: a length, a weight and a bending stiffness of the drill pipe;

determining a propulsion force corresponding to the target borehole trajectory based on the parameters, the target borehole trajectory, and the geological data comprises:

dividing the target borehole trajectory into at least one unit group based on the formation information;

dividing each unit group into at least one unit based on the length of the drill pipe;

taking one by one of the at least one unit as a target unit;

determining a calculated hole deviation angle and a calculated deflection corresponding to the target unit based on a preset initial propulsion force, a preset initial hole deviation angle, the length, the weight, the bending stiffness of the drill pipe, and the corresponding friction coefficient of the formation; drawing a predicted borehole trajectory based on the calculated hole deviation angle and the calculated deflection;

comparing the target borehole trajectory with different predicted borehole trajectories corresponding to different preset initial propulsion forces and different preset initial hole deviation angles;

selecting a predicted borehole trajectory that matches the target borehole trajectory as a candidate borehole trajectory; and taking the preset initial propulsion force corresponding to the candidate borehole trajectory and the calculated propulsion force of each unit determined according to the preset initial propulsion force as the propulsion forces corresponding to the target borehole trajectory.

* * * * *